United States Patent [19]

Thornton

[11] Patent Number: 4,834,352

[45] Date of Patent: May 30, 1989

[54] CLAMP

[76] Inventor: William Thornton, 204 Ella St., Lafayette, La. 70506

[21] Appl. No.: 119,711

[22] Filed: Nov. 12, 1987

Related U.S. Application Data

[63] Continuation-in-part of Ser. No. 93,992, Sep. 8, 1987, abandoned.

[51] Int. Cl.[4] ..... B25B 1/02

[52] U.S. Cl. ..... 269/6; 269/203; 269/238; 269/254 R; 269/282; 269/257; 269/274

[58] Field of Search ..... 339/264, 277 R; 219/158, 161; 269/238, 274, 203, 249, 282, 254 R, 257, 246, 247, 6

[56] References Cited

U.S. PATENT DOCUMENTS

| | | | |
|---|---|---|---|
| 189,767 | 4/1877 | Mole | 269/249 |
| 455,369 | 7/1891 | Vanderman | 269/282 |
| 614,387 | 11/1898 | Hargis | 269/238 |
| 2,040,669 | 5/1936 | Odmark | 269/238 |
| 3,575,405 | 4/1971 | Harding | 269/249 |
| 4,083,624 | 4/1978 | Timmer | 269/249 |
| 4,121,815 | 10/1978 | Paterson | 269/203 |
| 4,235,428 | 11/1980 | Davis | 269/203 |

FOREIGN PATENT DOCUMENTS

| | | | |
|---|---|---|---|
| 1335568 | 7/1963 | France | 269/203 |

*Primary Examiner*—Robert C. Watson
*Attorney, Agent, or Firm*—Milton S. Gerstein

[57] ABSTRACT

A spring clamp with a lower clamping jaw, an upper clamping jaw, a first handle portion extending rearwardly from and integrally connected with the lower clamping jaw, a second handle portion extending rearwardly from the upper clamping jaw, the upper clamping jaw having a slide-housing integrally connected to the second handle portion, and an L-shaped bracket having a first leg portion having a free end for sliding cooperation with the slide-housing and a second leg portion extending at right angles to another end of the first leg portion. The slide-housing has a first cooperating means and the first leg portion has second cooperating means, the first and second cooperating means being operatively associated to allow for the sliding movement of the first leg portion with respect to the slide-housing and for preventing the escape of the first leg portion from sliding engagement with the slide-housing means. The L-shaped bracket may be oriented in two different states so that smaller and larger workpieces may be accomodated and clamped between the second leg portion and the lower clamping jaw. In the first state, the free end of the first leg portion faces away from the lower clamping jaw, while in the second state the free end faces toward the lower clamping jaw.

20 Claims, 2 Drawing Sheets

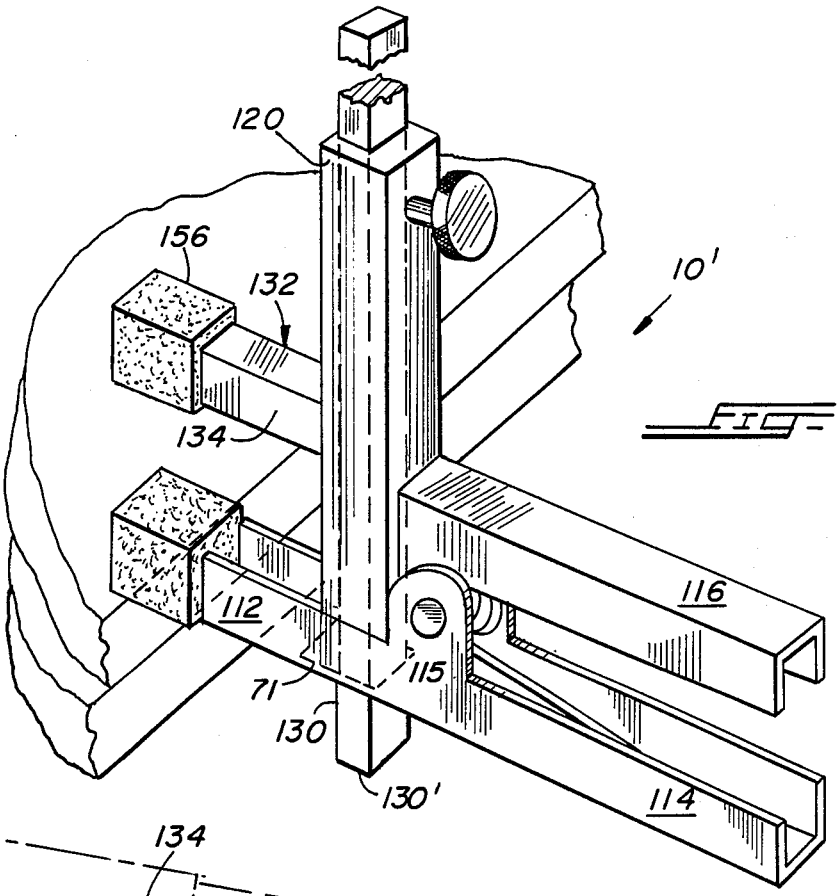
FIG. 4
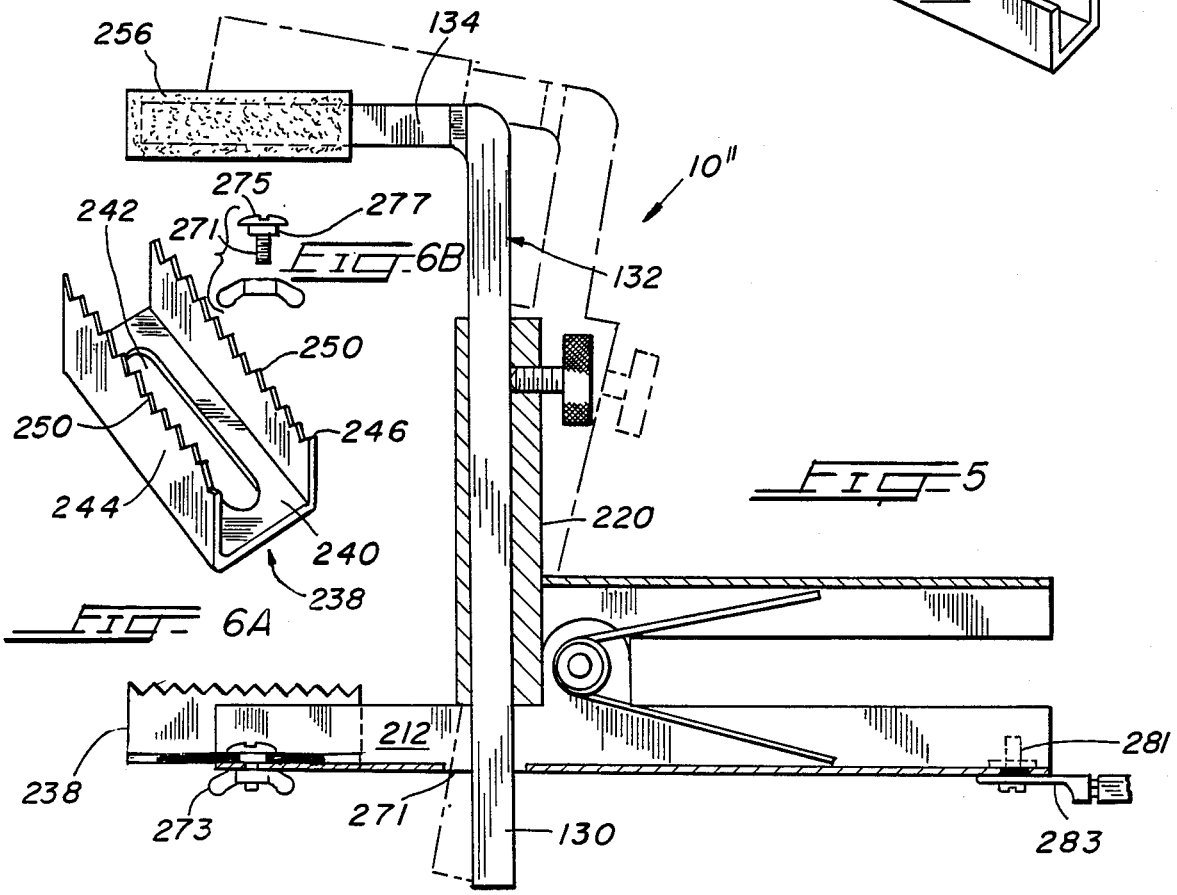
FIG. 6B
FIG. 5
FIG. 6A

CLAMP

CROSS-REFERENCE TO RELATED APPLICATION

This is a continuation-in-part of application Ser. No. 093,992, filed on Sept. 8, 1987 now abandoned.

BACKGROUND OF THE INVENTION

The present invention is directed to a clamp for firmly holding and securing a workpiece, or for use as a welder's ground clamp. Clamps are used in multifarious environments, such as for holding wooden furniture parts together for adhesive bonding, for holding metal parts together during the welding process, and the like. The clamp of the invention is in that class defined as spring clamps which provide a pair of clamping or holding jaws, one of which is pivoted to the other and urged toward the other jaw by a spring to secure the workpiece thereat in sandwich-like fashion. These prior art clamps, however, are not easily and readily adaptable to workpieces that vary greatly in size, whereby each clamp is expressly and specifically suitable for only a narrow range of sizes of workpieces. For larger-sized workpieces, larger spring clamps must be used, that cannot accomodate smaller-sized workpieces.

SUMMARY OF THE INVENTION

It is, therefore, the primary objective of the present invention to provide a spring clamp having a pair of clamping jaws which will readily and easily accomodate a large range of sizes of workpieces.

It is another objective of the present invention to provide such a spring clamp that will accomodate such a large range of sizes of workpieces such that such accomodation is continuous in that any sized workpiece within the size range may be accomodated, without any "blind" areas extant.

It is another objective of the present invention to provide such a spring clamp that may be used for holding and clamping any type of workpiece.

Toward these and other ends, the spring clamp of the present invention includes a lower clamping member at one end of which is mounted a rubber or soft pad element which actually grips a portion of a workpiece to be clamped, and an upper clamping member which incorporates an adjustable and removable L-shaped bracket having at one end another rubber or soft padded element for gripping an opposite portion of a workpiece. Each of the two clamping members is also provided with a rear handle element which are pivotally coupled together and are biased about the pivot axis by a spring provided between the two handle elements. The upper clamping member has a slide housing for slidingly mounting the L-shaped clamping bracket, which slide housing is integrally affixed to the end of the upper handle element and extends perpendicularly thereto. The slide housing extends directly adjacent to the upper surface of the lower clamping jaw when the two clamping members do not clamp a workpiece therebetween. The slide housing has an interior slideway in which slides one leg portion of the L-shaped bracket member. The slideway is open-sided at the portion thereof facing forwardly toward the upper rubber padded element, so that the other leg portion of the L-shaped bracket may project and extend outwardly therethrough. An indented or smaller-diameter rim portion of the other leg portion cooperates and receives nestled therein a pair of oppositely disposed retaining flanges projecting from the inner forward edge surfaces of the slide housing, so as to prevent the removal or falling out of the L-shaped bracket from the slide housing in the forward direction, through the open sided front surface thereof, while still permitting the entire L-shaped bracket to be removed by sliding it upwardly and out of the open top of the slide housing. The L-shaped bracket is positionable within the slide housing in two distinct manners: The first where the other leg portion, which has the upper rubber padded element affixed thereto at its forward, distal end, lies closer to the lower clamping member than the one leg portion of the L-shaped bracket contained within the slideway; and the second where the other leg portion lies farther away from the lower clamping member than the one leg portion, whereby conversion from the first to the second state automatically and relatively instantaneously converts the clamp from one state to clamp a relatively small-sized and narrow workpiece, to one that is able to accomodate a relatively much larger-sized and broader workpiece. A thumb screw secures the L-shaped bracket in any one of its many positions, whether in the first or second state thereof. The slideway has a length greater than the length of the one leg portion of the L-shaped bracket to ensure there are no "blind" spots where a particular thickness or size of workpiece could not be accomodated by the clamp of the invention, thus ensuring that a continuous range of sizes of workpieces may be accomodated within the range of sizes suitable to the particular clamp of the invention.

In anther embodiment of the invention, having special use as a welder's ground clamp, the lower clamping jaw is U-shaped for receiving therein a U-shaped gripping member that is used for gripping a lower portion of a pipe, or the like. The gripping member is adjustably positionable in the lower clamping jaw by a longitudinal channel formed in the base of the gripping member in cooperation with a screw passing through the base of the clamping jaw and channel, the screw being held in place at a desired portion of the channel by a wing nut. The lower handle portion of the clamp is also provided with a hole and screw therefor for connecting the end of a ground wire from a welder's generator supplying power to the weld gun, the clamp of the present invention being made of metal to provide such a ground connection. The base of the lower clamping jaw also is formed with a rectilinear-shaped through-opening in order to allow for the passage through the lower clamping jaw of part of the first leg portion of the L-shaped bracket, when the L-shaped bracket is extra-long, thereby allowing for even greater thicknesses of workpieces to be accomodated and clamped.

BRIEF DESCRIPTION OF THE DRAWING

The invention will be more readily understood with reference to the accompanying drawing, wherein:

FIG. 4 is an isometric view of the second embodiment of the clamp of the invention;

FIG. 5 is a side elevation view thereof;

FIG. 6A is a perspective view of the U-shaped gripping member of the lower clamping jaw of the clamp of FIG. 4; and FIG. 6B is an assembly view, in perspective, showing the parts for securing the U-shaped gripping member to the U-shaped lower clamping jaw.

DETAILED DESCRIPTION OF THE INVENTION

Figure 1:
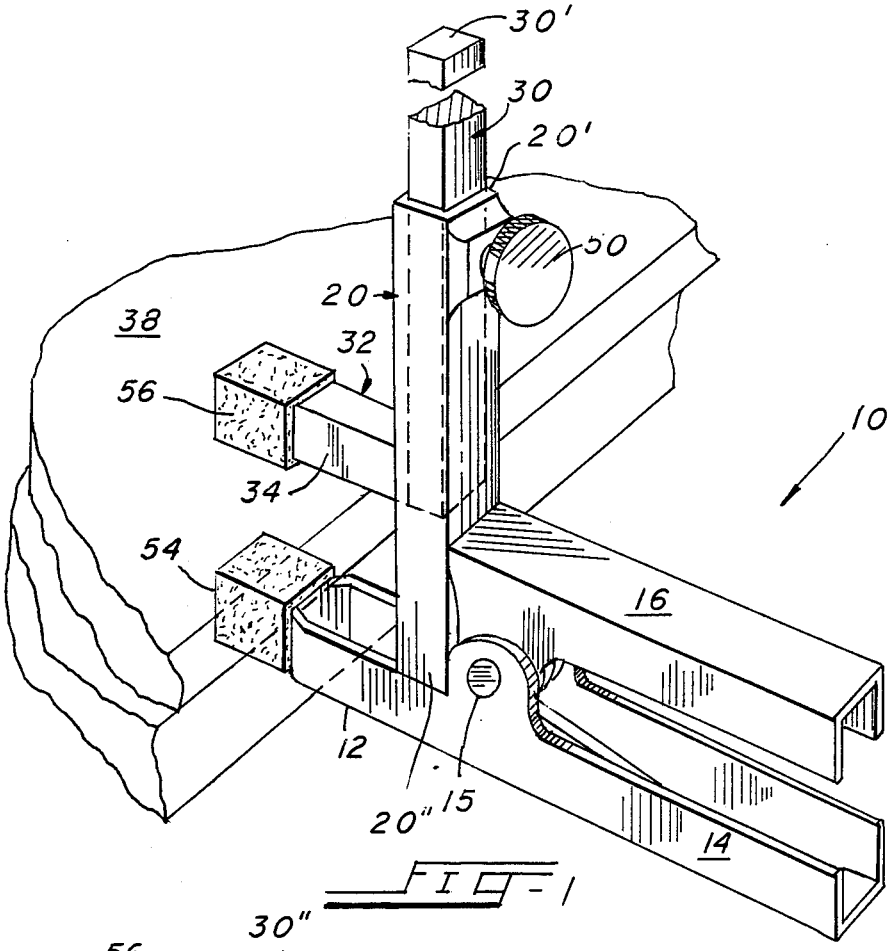
FIG. 1 is an isometric view of the first embodiment of the clamp of the invention in its first state thereof.
Figure 2:
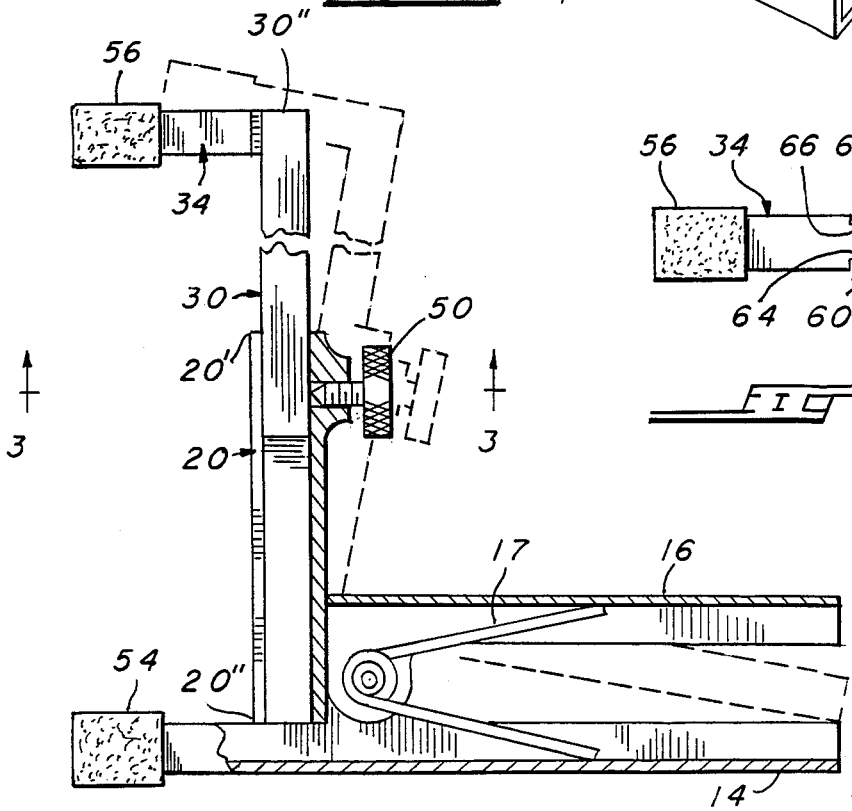
FIG. 2 is a side elevation view of the clamp of FIG. 1 in the second state thereof.

Referring now to the drawings in greater detail, the spring clamp of the invention is indicated generally by reference numeral 10. The clamp 10 has a first, lower clamping jaw 12 which is integrally connected with a first, lower handle element or portion 14 extending rearwardly from the rear surface of the lower jaw 12. A second, upper handle element or portion 16 is provided and extends parallel to and is coextensive with the lower handle element 14 when in its rest position. The two handle elements are pivotally connected together by a pivot shaft 15 as seen in FIGS. 1 and 2, and are urged away from each other by a spring 17 mounted between the two handle elements. The second, upper handle element 16 is integrally connected, at its forward-most surface, to a vertically-oriented slide-housing 20 which in the preferred embodiment is a hollow tube having a rectilinear-shaped cross section. The slide-housing 20 has an open end 20' and a lower end 20'', with the integral connection between the rear surface of the handle element 16 and the slide-housing being at the rear surface of the slide-housing at an intermediate portion thereof that is closer to the end 20'' than the end 20'. In the normal, rest state of the clamp 10, the lower end 20'' abuts against the upper surface of the lower clamp jaw 12, so that the alignment of the clamp takes place. The interior of the slide-housing 20 constitutes a slideway for slidingly receiving a first vertical leg portion 30 of an L-shaped bracket element 32. The leg portion 30 is also generally of rectilinear-shaped cross section for mating and sliding movement in the slideway of the housing 20. The first leg portion 30 has a free or unconnected upper end 30' and a lower end 30''. The L-shaped bracket 32 also has a second horizontal leg portion 34 which constitutes the second clamping jaw. The second leg portion 34 extends parallel to the lower clamping jaw 12 when the clamp is in its rest or normal state, and is substantially coextensive therewith. The second leg portion 34 projects perpendicularly from the lower end 30'' of the first leg portion, as seen in FIG. 2, and is formed integrally therewith.

The L-shaped bracket 32 may take on two separate states with respect to the slide-housing 20. The first state thereof is shown in FIG. 1, where the second leg portion 34 lies closer to the lower clamping jaw 12 than the free end 30' of the first leg portion 30. The second state thereof is shown in FIG. 2, where the second leg portion 34 lies farther away from the lower clamping jaw 12. In the first state, the connected or lower end 30'' of the first leg portion is inserted first into the slideway of the slide-housing 20 through the open end 20' thereof, while in the second state thereof, the upper or free end 30' is inserted first into the slideway through the open end 20'. In the first state shown in FIG. 1, a workpiece 38 of relatively narrow thickness may be clamped between the lower clamping jaw 12 and the upper one 34. When it is desired to clamp therebetween a workpiece of much greater relative thickness, such is easily and readily accomplished by removing the L-shaped bracket and inserting the free end 30' into the open end 20' first to position the L-shaped bracket in its second state shown in FIG. 2, so that the much larger relative thickness may be readily accomodated, with only fine tuning of the upper jaw 34 being necessary thereafter. Whether in the first or second state, a thumb screw 50 having a threaded shank passing through an appropriately-provided hole in the rear surface of the slide-housing retains the L-shaped bracket in the desired position in the slideway, the fine-tuning above-stated requiring only small vertical adjustment of the first leg portion and its retention by the thumb screw.

Each of the ends of the lower clamping jaw 12 and upper clamping jaw or second leg portion 34 is provided with a rubber or soft clamping pad 54, 56, respectively, between which the workpiece is actually gripped and clamped. Preferably, each pad 54, 56 has a slightly greater size than the jaws themselves so that only the pads contact the workpiece.

Figure 3:
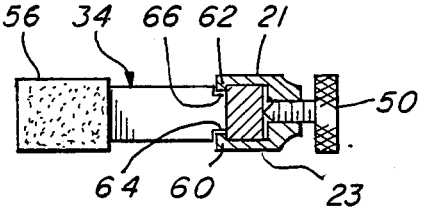
FIG. 3 is a cross-sectional view taken along line 3—3 of FIG. 2.

The second leg portion projects outwardly and forwardly from the lower or connected end of the first leg portion and protrudes through the housing 20 via the opened forward portion thereof, and is prevented from escaping from the slideway in the forward direction by means of a pair of vertically-oriented, oppositely-disposed recesses or grooves 62, 64 that extend the entire height or thickness of the second leg portion, which recesses receive therein, respectively, a pair of mutually-facing flanges or beads 60, 62 formed along the inner surface of the side walls 21, 23, respectively, of the housing 20. Each bead or flange extends from its respective side wall at the forward edge thereof, as clearly shown in FIG. 3. The recesses 64, 66 define a reduced-diameter portion of the second leg portion adjacent its end connected to the end 30'' of the second leg portion.

When using the clamp 10, for a relatively thin or narrow workpiece, the L-shaped clamp is positioned as shown in FIG. 1, while for a relatively thicker or broader workpiece, the L-shaped bracket is positioned as shown in FIG. 2. This allows for quick and facile adaptation of the clamp to two workpieces of considerable difference in size, without needing to pass through all the continuous intermediate stages necessary in prior art clamps.

The L-shaped bracket is preferably made of mild strength aluminum so that the point of the threaded shank of the thumb screw 50 may bite into the surface of the first leg portion and prevent slippage. The length of the slideway is greater than the length of the first leg portion so that all intermediate positions of the clamp may be realized, without any "blind spots" present. The size and length of the L-shaped bracket's portions will vary depending upon the end use, as will the slideway and lower clamping jaw.

It is possible to provide a different slide arrangement, where the female receiving portions or recesses 64, 66, are provided in the housing 20, and the male parts on the second leg portion 34, as in the mortise and tenon type connection or dovetail connection.

A modification of the clamp 10 is shown in FIG. 4, and allows for the accomodation of extra-long first leg portions 130 of the L-shaped bracket 132 when such is positioned in the second state thereof shown in FIG. 2. Such accomodation is achieved via a rectilinear-shaped through-opening or cutout 71 formed in the case or lower wall of the lower clamping jaw 112. This through-opening is in substantial alignment with the hollow interior of the slide-housing 120 when the handle means 114,116 are in their normal, spaced-apart state when a workpiece is being clamped. The free end 130' of the L-shaped bracket in the second state thereof may project through the through-opening 71 as shown in FIG. 4 in order to accomodate any size thickness of workpiece, offering a much greater range of workpiece thicknesses that may be accomodated as compared with the clamp 10. The opening 71 preferably has a length as taken in the direction parallel to the length of the clamping jaw 112 that is greater than the thickness of the first leg portion 130, which thickness is taken in the same direction as the length of the opening 71, whereby, when the two handle elements 114 and 116 are pivoted about the pivot pin 115, clearance is provided for the portion of the first leg portion situated within the through-opening, in the manner best seen in FIG. 5. Of course, the L-shaped bracket may also be used in the first state thereof, in the manner shown in FIG. 1, with the free end 130' projecting upwardly and out from the upper end of the slide housing 120.

Referring now to FIGS. 5–6, there is shown a second embodiment of the clamp of the invention, indicated generally by reference numeral 10''. The clamp 10'' may be used in the same manner as the clamp 10, but has additional use as a welder's clamp. When welders use a weld gun of a welding apparatus for welding pipes, hollow tubes, and the like, the ground wire of the welding apparatus may be grounded, which is presently done by first welding an angle iron, or the like, to the pipe itself if the end of the pipe is not accessible. Then the ground wire clip is secured to this angle iron to achieved the ground. This is a timely and extremely inconvenient process. The clamp 10'' obviates the need for using and welding an angle iron to the pipe proper and itself clamps between its upper and lower clamping jaws the pipe section at which it is located and at which the grounding of the welding apparatus is to be carried out.

The clamp 10'' also includes a lower, U-shaped clamping jaw 212 with a rectilinear-shaped opening 271 through which passes a part of the first leg portion 130 of a L-shaped bracket 132, as described previously for the clamp 10. The lower clamping jaw 212 is provided with a U-shaped, alligator gripping member 238 best seen in FIG. 6A. The gripping member 238 has a base wall portion 240 in which is formed a longitudinally-extending channel 242, and a pair of upstanding side walls 244, 246 projecting from the side edge surfaces of the base wall portion 240. The upper edge surface of each side wall is provided with serrations 250 to aid in the gripping of a pipe, or the like, when the clamp 10'' is used as a welder's ground clamp. The gripping member 238 is adjustably positionable in the lower clamping jaw 212 in order to accomodate different sizes of pipes or the like and different lengths of second leg portions 134 with the concomitant different projection of the upper gripping surface pad 256, which in this embodiment is preferably more elongated than the pads 56 or 156 for better gripping a curved surface of a pipe, or the like. The alligator clamping member 238 is secured at a desired position in the lower, U-shaped clamping jaw 212 via a screw or carriage bolt 271 and associated wing nut 273, the shank of the screw passing through a hole formed in the lower clamping jaw adjacent the front end thereof, and also through the channel 242, as best seen in FIG. 5. By simply loosening the wing nut and moving the alligator gripping member relative to the lower clamping member, with the screw 271 remaining stationary as the channel 242 moves therepast, it is possible to either move the alligator gripping member closer or farther away from the slide-housing 220. The carriage bolt 271 has an enlarged, conventional head portion 275 by which it is turned, and also includes a lower, secondary rectilinear-shaped head portion or built-in nut portion 277 which fits snugly inside the channel 242, so that no wrench is needed to tighten the bolt, since the built-in nut remains within the channel 242 and prevents rotation of the screw as the wind nut 273 is rotated to tighten the connection.

The clamp 10'' also includes a ground-wire receptacle or hole which threadingly receives therein a ground-screw 281 for securing and grounding a ground-wire lead clip 283. The ground wire clip 283 is part of a ground wire of a conventional welding apparatus having a welding gun for welding pipes, or the like. Thus, when a welder wishes to weld a pipe, or the like, and when the end of the pipe is not accessible for securing the ground-wire clip thereto, the clamp 10'' is used instead, the clamp 10'' being made of suitable metal or alloy to effect the grounding, which obviates the need of welding an angle iron to the pipe being welded, which has hitherto been necessary.

While a specific embodiment of the invention has been shown and described, it is to be understood that numerous changes and modifications maay be made therein without departing from the scope, spirit and intent thereof as set forth in the appended claim.

What is claimed is:

1. A spring clamp for clamping a workpiece, comprising:

a lower clamping jaw means having a forward portion defining a first clamping jaw, and rear portion defining a first handle element, said first clamping jaw having a forward distal end used for contacting a portion of a workpiece to help clamp the workpiece;

an upper clamping jaw means having a rear portion defining a second handle element, a slide-support means extending perpendicularly to said second handle element; and an L-shaped bracket means comprising a first leg portion having a first upper free and unconnected end and a second lower end positionable within said slide-support means for sliding movement therein and a second leg portion extending perpendicularly to and integrally connected with said first leg portion adjacent said second lower end, said second leg portion projecting away from said first leg portion in the forward direction away from said second handle element and defining a second forward distal end used for contacting a portion of a workpiece to help clamp the workpiece; said slide-support means comprising means for preventing the escape of said first leg portion therefrom in said forward direction, said slide-support means further comprising a first open front surface through which projects said second leg portion, and an upper open end through which said first leg portion may be inserted into and removed from said slide-support means and through which projects an upper portion of said second leg portion during at least some positions of said second leg portion in said slide-support means, said L-shaped bracket being positionable in said slide-support means in two different states, a first one thereof where said second leg portion is positioned closer to said lower first clamping jaw than said first free end of said first leg portion, and a second one thereof where said second leg portion is positioned farther away than said first free end of said first leg portion;

pivot means for pivotally coupling said first handle element to said second handle element;

spring means mounted between and in contact with said first and second handle elements for biassing said second forward distal end of said second leg portion toward said first forward distal end of said first clamping jaw;

means operatively associated with said slide-support means for securing said first first leg portion at selected positions along said slideway thereof.

2. The spring clamp according to claim 1, wherein said each of said first and second clamping jaw means further comprises a padded means mounted to the respective one of said first and second forward distal end between which a workpiece is gripped and clamped.

3. The spring clamp according to claim 1, wherein said pivot means comprises a pivot shaft pivotally connecting portions of said handle elements directly adjacent the rearwardmost portions of said lower and upper clamping jaw means.

4. The spring clamp according to claim 3, wherein said rearwardmost portion of said upper clamping jaw means comprises a rear lower surface portion of said second lower end of said first leg portion of said L-shaped bracket.

5. The spring clamp according to claim 1, wherein said means operatively associated with said slide-support means comprises a thumb screw comprising a shank, said slide-support means having an opening formed in one wall thereof through which projects said shank of said thumb screw for abutment against a portion of said first leg portion in order to secure said first leg portion in a desired position in said slideway.

6. The spring clamp according to claim 1, wherein said slideway has a total length greater than the length of said first leg portion, so that a continuous range of positions of said first leg portion may be achieved in said slideway.

7. The spring clamp according to claim 1, wherein said means for preventing the escape of said first leg portion comprises a pair of facing flange means, one of said flange means extending from the inner edge surface of a first side wall of said slide-support means, and the other of said flange means extending from the innter edge surface of a second side wall of said slide-support means, said flange means projecting toward each other.

8. The spring clamp according to claim 7, wherein said second leg portion of said L-shaped bracket comprises a reduced-diameter portion at a portion thereof directly adjacent said second lower end of said first leg portion, said reduced diameter portion receiving therein said pair of flange means to prevent the escape of said L-shaped bracket forwardly from said slide-support means.

9. The spring clamp according to claim 8, wherein said reduced-diameter portion comprises a pair of oppositely disposed grooves formed respectively in the side surfaces of said first leg portion.

10. The spring clamp according to claim 1, wherein said second lower end of said first leg portion abuts against the top surface of said first clamping jaw when no workpiece is clamped between said clamping jaw means, in order to keep said clamping jaw means properly aligned.

11. A spring clamp comprising:

a lower clamping jaw;

an upper clamping jaw;

a first handle portion extending rearwardly from and connected with said lower clamping jaw;

a second handle portion extending rearwardly from said upper clamping jaw, said upper clamping jaw comprising a vertical upright portion connected to said second handle portion, and an L-shaped bracket means having a first leg portion having a free end, and a second end; and a second leg portion extending at right angles to said first leg portion adjacent said second end of said first leg portion;

said upright portion and said first leg portion being relatively slidingly mounted with respect to each other, one of said upright portion and said first leg portion defining a hollow slide interior and the other of said upright portion and said first leg portion defining an elongated element received in said hollow slide interior, whereby the relative sliding movement therebetween is allowed;

each of said upright portion and said first leg portion comprising cooperating means for allowing the relative sliding movement and for preventing the escape of said first leg portion from said upright portion;

means for retaining said first leg portion at a desired relative position with respect to said upright vertical portion;

pivot means pivotally connecting said first and second handle portions; and spring means mounted between and in operative engagement with said first and second handle portions for biassing said handle portions away from each other and for biassing said upper and lower clamping jaws toward each other;

said lower clamping jaw comprising a substantially U-shaped like member, and a gripping means slidingly mounted in said U-shaped like member, said gripping means having a wall portion thereof having an elongated channel formed therein; said member having a through-opening for cooperation with said channel; and means for adjustably mounting said gripping means with respect to said member passing through both said through-opening and said channel.

12. The spring clamp according to claim 11, wherein said gripping means is also substantially U-shaped like and being received snugly in said member, each of said gripping means and said member having a base wall and a pair of side walls extending perpendicularly from the side edges of said base, said channel being formed in said base wall of said gripping means, and said through-opening being formed in said base wall of said member.

13. The spring clamp according to claim 12, wherein each said side wall of said gripping means comprises a serrated upper edge surface to define the gripping surface of said gripping means, whereby pipes, and the like, may be gripped between said upper and lower clamping jaws.

14. The spring vlamp according to claim 12, wherein said base wall of said member further comprises an enlarged opening in linear alignment with said hollow slide interior when said lower and upper clamping jaws are in their normally-biassed clamping states, whereby said free end of said first leg portion of said L-shaped bracket means may project through and outwardly of said enlarged opening when said L-shaped bracket means is used in its state thereof for accomodating thicker workpieces.

15. The spring clamp according to claim 11, further comprising securing means for securing a ground wire thereto, so that the spring clamp may serve as a welder's ground clamp when welding pipes, and the like.

16. The spring clamp according to claim 15, in combination with a welding generator, said generator having a ground wire thereof, the end of said ground wire being attached to said securing means.

17. A spring clamp comprising:

a lower clamping jaw;

an upper clamping jaw;

a first handle portion extending rearwardly from and connected with said lower clamping jaw;

a second handle portion extending rearwardly from said upper clamping jaw, said upper clamping jaw comprising a vertical upright portion connected to said second handle portion, and an L-shaped bracket means having a first leg portion having a free end, and a second end; and a second leg portion extending at right angles to said first leg portion adjacent said second end of said first leg portion;

said upright portion and said first leg portion being relatively slidingly mounted with respect to each other, one of said upright portion and said first leg portion defining a hollow slide interior and the other of said upright portion and said first leg portion defining an elongated element received in said hollow slide interior, whereby the relative sliding movement therebetween is allowed;

each of said upright portion and said first leg portion comprising cooperating means for allowing the relative sliding movement and for preventing the escape of said first leg portion from said upright portion;

means for retaining said first leg portion at a desired relative position with respect to said upright vertical portion;

pivot means pivotally connecting said first and second handle portions; and spring means mounted between and in operative engagement with said first and second handle portions for biassing said handle portions away from each other and for biassing said upper and lower clamping jaws toward each other;

said lower clamping jaw comprising an opening extending completely through sid lower clamping jaw and being in linear alignment with said hollow slide interior of said one of said upright portions and said first leg portion when said upper and lower clamping jaws are in their normally-biassed, clamping states, whereby said free end of said first leg portion of said L-shaped bracket means may project through and outwardly of said opening when said L-shaped bracket means is used in its state thereof for accomodating thicker workpieces.

18. The spring clamp according to claim 17, wherein said opening of said lower clamping jaw has a length taken in the direction parallel to the length of said lower clamping jaw greater than the thickness of said firstly leg portion of said L-shaped bracket means, which thickness is also taken in the direction parallel to the length of said lower clamping jaw, whereby said upper and lower clamping jaws are allowed rotational movement about said pivot means without obstruction from the portion of said first leg portion passing through said opening of said lower clamping jaw.

19. A clamp for clamping a workpiece, comprising:

a lower clamping jaw means having a forward portion defining a first clamping jaw;

an upper clamping jaw means comprising an upright; vertical portion, and an L-shaped bracket means comprising a first leg portion having a first upper free end and a second lower end, and a second leg portion extending perpendicularly to and connected with said first leg portion adjacent said second lower end thereof, said second leg portion projecting away from said first leg portion in the forward direction and comprising a forward distal end used for contacting a portion of a workpiece, said forward distal defining an upper clamping jaw, a workpiece being clamped between said upper and lower clamping jaws;

means coupling said upper and lower clamping jaw means together for relative positioning therebetween;

said upright vertical portion and said first leg portion being relatively slidingly mounted with respect to each other, one of said upright vertical portion and said first leg portion defining a hollow slide interior and the other of said upright vertical portion and said first leg portion defining an elongated element received in said hollow slide interior whereby the relative sliding movement therebetween is allowed; and means for releasably securing said one of said upright vertical portion and said first leg portion in a desired position in said hollow slide interior of said other of said upright vertical portion and said first leg portion, so that continuous adjustment of the relative positions therebetween is possible;

said upper clamping jaw comprising an upper, flat, free, unconnected workpiece-contacting surface and a lower, flat, free, unconnected workpiece-contacting surface parallel to said upper workpiece-contacting surface, whereby each of said workpiece-contacting flat surfaces may be used for abutment against a workpiece positioned between said clamping jaws depending upon whether said first or second end of said first leg portion is closer to said lower clamping jaw means.

20. The clamp according to claim 19, wherein said upper clamping jaw comprises a padding defining a padded said upper flat workpiece-contacting surface and a padded said lower flat workpiece-contacting surface.

* * * * *